US009302529B2

(12) United States Patent
Izawa et al.

(10) Patent No.: US 9,302,529 B2
(45) Date of Patent: Apr. 5, 2016

(54) MECHANICAL PENCIL

(75) Inventors: Hirotake Izawa, Yokohama (JP); Takeshi Kobayashi, Yokohama (JP); Kyo Nakayama, Yokohama (JP)

(73) Assignee: MITSUBISHI PENCIL CO., LTD., Tokyo (JP)

( * ) Notice: Subject to any disclaimer, the term of this patent is extended or adjusted under 35 U.S.C. 154(b) by 291 days.

(21) Appl. No.: 14/006,786

(22) PCT Filed: Apr. 2, 2012

(86) PCT No.: PCT/JP2012/058823

§ 371 (c)(1),
(2), (4) Date: Sep. 23, 2013

(87) PCT Pub. No.: WO2012/137702

PCT Pub. Date: Oct. 11, 2012

(65) Prior Publication Data

US 2014/0016982 A1 Jan. 16, 2014

(30) Foreign Application Priority Data

Apr. 7, 2011 (JP) ..... 2011-085257

(51) Int. Cl.

| | |
|---|---|
| ***B43K 21/08*** | (2006.01) |
| ***B43K 21/00*** | (2006.01) |
| ***B43K 21/027*** | (2006.01) |

(Continued)

(52) U.S. Cl.

CPC ..... *B43K 21/08* (2013.01); *B43K 21/00* (2013.01); *B43K 21/003* (2013.01); *B43K 21/006* (2013.01); *B43K 21/027* (2013.01);

(Continued)

(58) Field of Classification Search

CPC combination set(s) only.
See application file for complete search history.

(56) References Cited

U.S. PATENT DOCUMENTS 1,584,050 A * 5/1926 Vail ..... B43K 24/10 401/194
2,332,258 A 10/1943 Ponath (Continued)

FOREIGN PATENT DOCUMENTS

DE 3641432 C1 2/1988
JP 54-25339 U 2/1979

(Continued)

OTHER PUBLICATIONS

Extended European Search Report dated Sep. 3, 2014, issued in corresponding European Patent Application No. 12768242.5 (7 pages).

(Continued)

*Primary Examiner* — David Walczak
(74) *Attorney, Agent, or Firm* — Westerman, Hattori, Daniels & Adrian, LLP

(57) ABSTRACT

A mechanical pencil having a rotational drive mechanism which gradually rotates a writing lead on application of writing pressure and allowing rotational operation of the writing lead to be known reliably. First and second cam faces 6*a* and 6*b* are respectively formed at one end face and the other end face of a rotor 6 in an axial direction, and first and second fixed cam faces 13*a* and 14*a* arranged on the body cylinder side so as to respectively face the first and the second cam faces are provided to form the rotational drive mechanism for the writing lead. A plurality of grooves 8*a* in the axial direction are formed at a slider 8 of a pipe end 7 which projects forwardly from a body cylinder 1. Therefore, the user can see the grooves 8*a* (provided for the slider 8) rotated by rotation of the rotor 6.

12 Claims, 10 Drawing Sheets

(51) Int. Cl.

| | |
|---|---|
| ***B43K 21/16*** | (2006.01) |
| ***B43K 21/22*** | (2006.01) |
| ***B43K 29/02*** | (2006.01) |
| ***B43K 29/08*** | (2006.01) |

(52) U.S. Cl.
CPC ..... *B43K 21/16* (2013.01); *B43K 21/22* (2013.01); *B43K 29/02* (2013.01); *B43K 29/08* (2013.01)

(56) References Cited

U.S. PATENT DOCUMENTS 2,751,700 A * 6/1956 Danjczek ..... B43K 29/00 40/334
2010/0254761 A1 10/2010 Wheeler, Jr.

FOREIGN PATENT DOCUMENTS

| | | | |
|---|---|---|---|
| JP | 3882272 | B2 | 2/2007 |
| JP | 3885315 | B2 | 2/2007 |
| JP | 2010-36391 | A | 2/2010 |
| JP | 2010-120204 | A | 6/2010 |
| WO | 2009/069390 | A1 | 6/2009 |

OTHER PUBLICATIONS

International Search Report for PCT/JP2012/058823, Mailing Date of May 1, 2012.

* cited by examiner

MECHANICAL PENCIL

TECHNICAL FIELD

The present invention relates to a mechanical pencil which can rotate a writing lead (refill lead) by writing pressure.

BACKGROUND ART

In the case of writing with a mechanical pencil, it is generally often the case that the mechanical pencil is not used in a situation where a body cylinder is perpendicular to a writing side (page), but used in a situation where the body cylinder is somewhat inclined to the writing side. In the case where the body cylinder is thus inclined for writing, there arises a phenomenon that a drawn line becomes bold as compared with that in the beginning, since the writing lead may locally abrade (partially wear) as the writing proceeds. Further, not only the drawn line changes in boldness, but also there arises a phenomenon that the drawn line changes in thickness (drawn line becomes thin) as the writing proceeds, since a contact area of the writing lead changes with respect to the writing side.

In order to avoid the above-mentioned problem, when the writing is carried out with the body cylinder being rotated, then it is possible to avoid such a problem that, as described above, the drawn line becomes bold as it is drawn, since a sharper side of the writing lead is rotatably in contact with the page when writing. However, when you write down with the body cylinder being rotated, there arises a problem in that operation of re-holding the body cylinder is required while the writing proceeds, leading to considerable reduction in writing efficiency.

In that case, it is not impossible to write down by re-holding the body cylinder and rotating it in a stepwise manner, in the case where exterior of the body cylinder is formed to be cylindrical. However, in the case of the mechanical pencil whose exterior may not be cylindrical and which may be designed to have a projection in the middle or which is a side-knock-type mechanical pencil, it is difficult to write by re-holding the body cylinder to be rotated in a stepwise manner as described above.

Now, Patent Documents 1 and 2 disclose a mechanical pencil having a rotational drive mechanism in which retracting operation of the writing lead is carried out to rotate the above-mentioned writing lead itself. According to the mechanical pencil as disclosed in Patent Documents 1 and 2, vertical projections and vertical grooves are arranged alternately in a body cylinder, and a cam part which has slopes, each being across the vertical projection and groove, is formed into the shape of a ring. Further, a rotor having formed thereon projections at intervals in a circumferential direction is accommodated in the body cylinder.

In this arrangement, by retreating the writing lead greatly (retracting it greatly), the above-mentioned rotor is pushed upwards within the body cylinder, and the projection of the rotor passes over the vertical projection formed at the cam part in the body cylinder and falls into the next groove via the above-mentioned slope, to thereby rotate the above-mentioned rotor. That is to say, in conjunction with the rotation of the above-mentioned rotor, the writing lead is rotationally driven.

However, according to the above-mentioned mechanical pencil, when the rotor is rotated, there is a problem in that the writing lead needs to have a large enough retreat stroke to allow the projection on the rotor side to pass over the vertical projection formed in the body cylinder. Thus, it is necessary to carry out the particular operation of rotating the writing lead when writing, and it is difficult to improve writing efficiency.

Then, the present applicant has proposed a mechanical pencil in which the writing lead is rotationally driven in one direction by of slight retreat and advance action of the writing lead caused by writing pressure and the writing efficiency is not affected; this is disclosed in Patent Document 3, for example.

PRIOR ART DOCUMENTS

Patent Documents

Patent Document 1: Japanese Patent No. 3882272
Patent Document 2: Japanese Patent No. 3885315
Patent Document 3: International Publication WO 2009/069390 pamphlet

SUMMARY OF THE INVENTION

Problems to be Solved by the Invention

Incidentally, the mechanical pencil disclosed in Patent Document 3 is arranged such that the rotational drive mechanism of the above-mentioned writing lead is improved and rotational operation by the above-mentioned rotational drive mechanism can be observed through a part (made a transparent material) of the body cylinder. Accordingly, when using the mechanical pencil, the rotational operation by the rotational drive mechanism can be checked, thus causing a user to have interests or a pleasure somewhat and also appealing considerable product differentiation.

On the other hand, in the mechanical pencil as disclosed in Patent Document 3, since the rotational operation by the above-mentioned rotational drive mechanism may be observed through the part (made of the transparent material) of the body cylinder, there is a problem that the rotational operation is somewhat difficult to observe through the transparent material. In addition, the part through which the rotational operation can be seen may be hidden with a finger gripping the mechanical pencil and an angle at which it is observed may be limited. Therefore, it is difficult to fully demonstrate the above-mentioned original operational effect.

The present invention arises in view of the above-mentioned problem and aims to provide a mechanical pencil in which rotational operation of a writing lead by the above-mentioned rotational drive mechanism can be observed directly without being influenced with a finger gripping the mechanical pencil, and it is possible to know the above-mentioned rotational operation reliably when writing.

Means for Solving the Problems

The mechanical pencil in accordance with the present invention made in order to solve the above-mentioned problems is a mechanical pencil arranged to grasp and release a writing lead by reciprocation of a chuck provided in a body cylinder so as to inch the above-mentioned writing lead forward, having a rotational drive mechanism for rotationally driving a rotor in one direction in conjunction with retreat operation of the writing lead into the body cylinder by the writing pressure applied to the above-mentioned writing lead and forward movement of the writing lead from the body cylinder by releasing the writing pressure, and arranged to transmit rotational motion of the above-mentioned rotor to the above-mentioned writing lead, wherein a component arranged to extend from the above-mentioned body cylinder forwardly or rearwardly of the above-mentioned body cylinder is arranged to be rotationally driven in conjunction with the rotational motion of the above-mentioned rotor), and the above-mentioned component is provided with a display means for displaying a rotation state of the above-mentioned component.

In this case, the above-mentioned display means is printing or a coating provided on the above-mentioned component in a preferred embodiment. Further, in another preferred embodiment, the above-mentioned display means is arranged by forming a cross-sectional shape perpendicular to an axial direction of the above-mentioned component into a particular outer shape different from a true circle.

Furthermore, as an example of the latter where the component is formed into a different shape, it is possible to suitably employ an arrangement in which grooves are formed on a surface of the above-mentioned component in the axial direction.

Still further, it is possible to apply the above-mentioned arrangement to a slider for supporting a pipe end as the above-mentioned component arranged to extend from the body cylinder forwardly of the above-mentioned body cylinder. And, it is possible to apply the above-mentioned arrangement to a knock cover which achieves the reciprocation of the above-mentioned chuck as the above-mentioned component arranged to extend from the body cylinder rearwardly of the above-mentioned body cylinder.

Effect of the Invention

According to the above-described mechanical pencil in accordance with the present invention, on application of the writing pressure, the rotor which constitutes the rotational drive mechanism is rotationally driven in one direction, which is transmitted to the writing lead so that the writing lead is rotationally driven in the same direction. Thus, it is possible to prevent local abrasion of the writing lead according to the progress of the writing and to solve the problem that the thickness of a drawn line and the boldness of the drawn line may change badly.

Further, since it is arranged that the component arranged to extend from the body cylinder forwardly or rearwardly of the body cylinder (for example, the slider which supports the pipe end or the knock cover which projects rearwardly of the body cylinder) is rotationally driven in conjunction with the rotational motion of the above-mentioned rotor, it is possible to check the rotation state easily.

In addition, since the display means is provided for the above-mentioned component, i.e., the slider or the knock cover, the rotational operation can be checked more clearly.

According to these arrangements, as the writing proceeds, the slider which supports the pipe end or the knock cover which projects rearwardly of the body cylinder is rotationally driven in a stepwise manner, thereby causing a user to have interests or a pleasure somewhat and also appealing considerable product differentiation. Further, when inspecting and confirming operation of the mechanical pencil at the time of manufacture and assembly, it is possible to easily visually determine whether it is of a good quality or not.

BEST MODE FOR CARRYING OUT THE INVENTION

Figure 1:
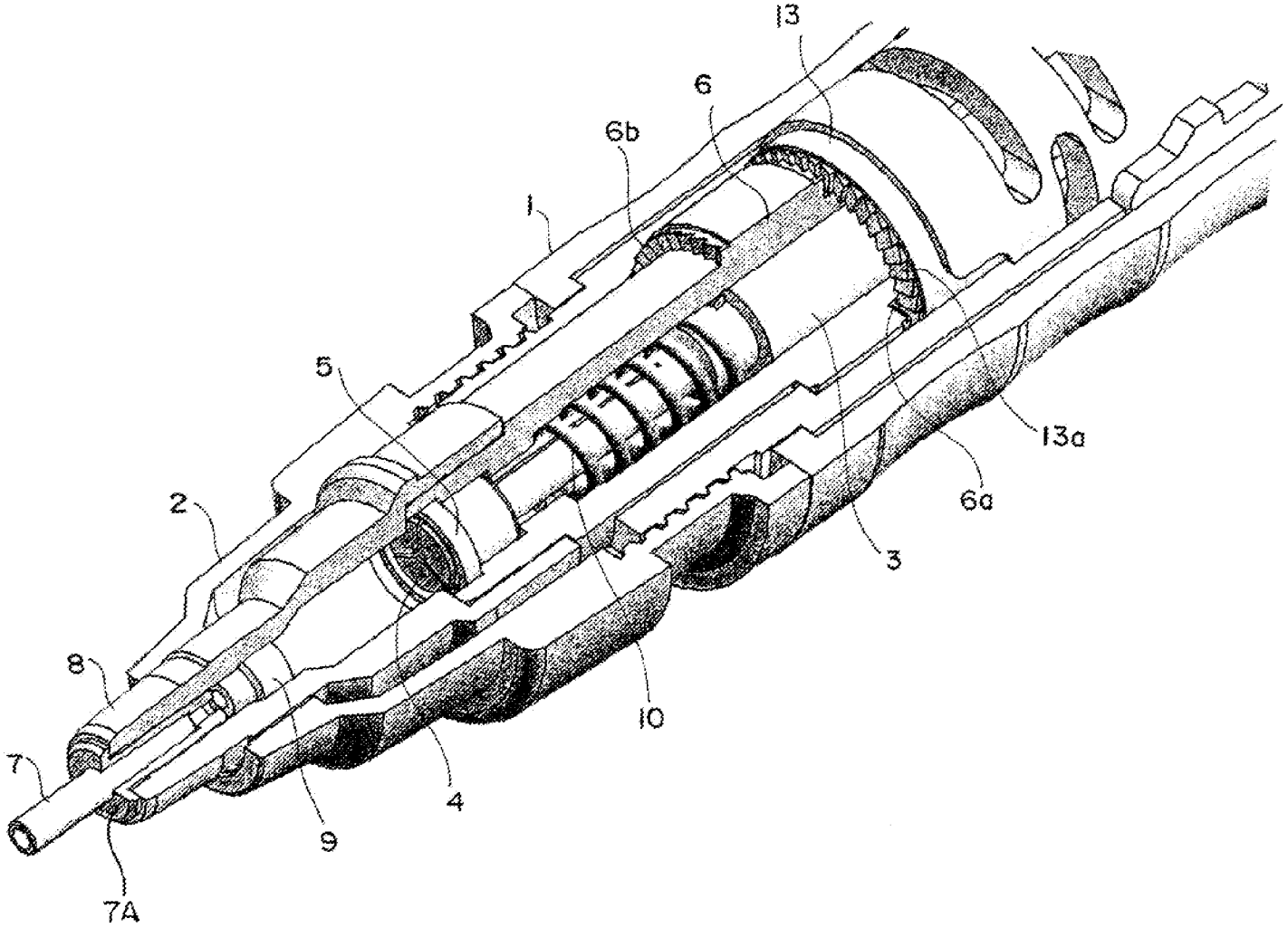
FIG. 1 is a perspective view of a first half part (partially broken-away) of a mechanical pencil in accordance with the present invention.
Figure 2:
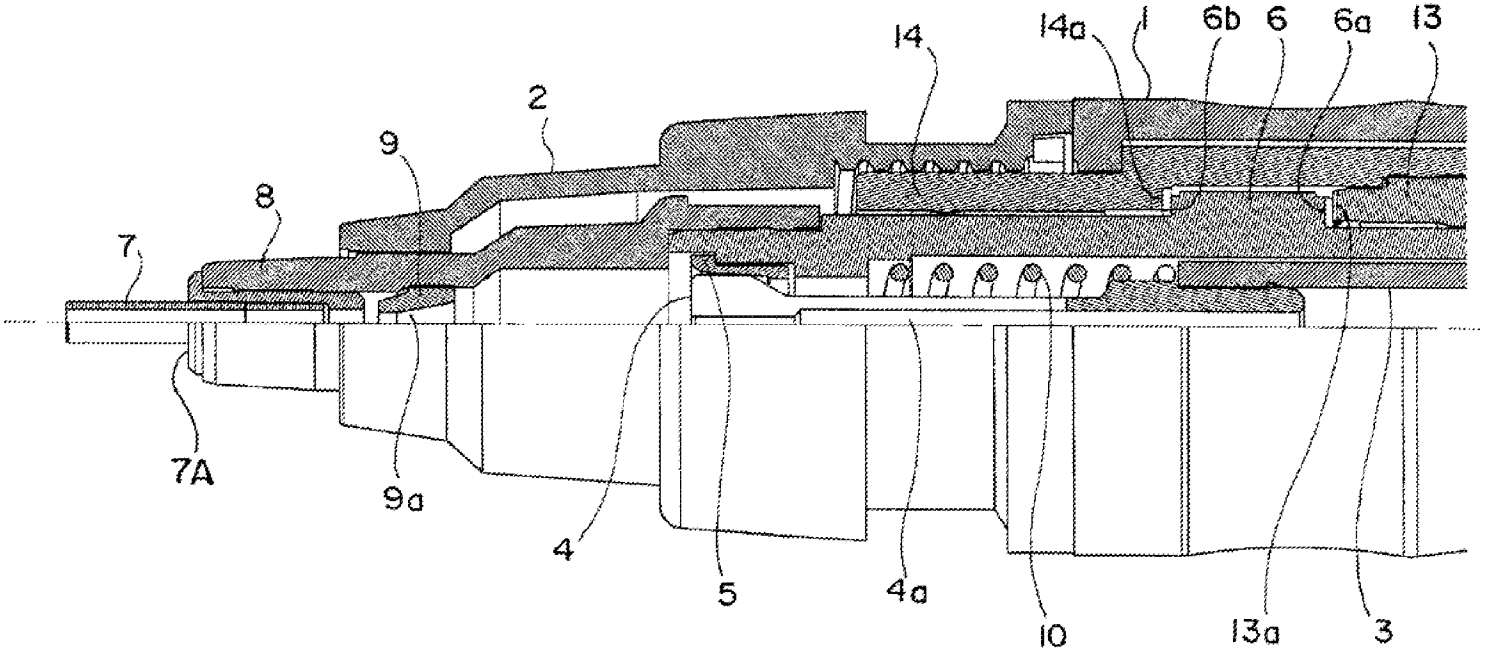
FIG. 2 is a fragmentary sectional side elevation similarly showing the first half part.

Hereinafter, a mechanical pencil in accordance with the present invention will be described with reference to the embodiments illustrated in the drawings. FIGS. 1 and 2 show a first half part of the mechanical pencil which is a principal part of the present invention. FIG. 1 is a perspective view showing its principal part, partially broken-away, and FIG. 2 is a side elevation where a left half portion is shown in section.

Reference numeral 1 denotes a body cylinder which constitutes the exterior, and reference numeral 2 indicates a base attached to a tip portion of the above-mentioned body cylinder 1. A cylindrical lead case 3 is accommodated coaxially in the center of the above-mentioned body cylinder 1, and a chuck 4 is connected with a tip portion of the lead case 3.

The chuck 4 is mounted so that a through hole 4*a* is formed along an axis thereof, a tip portion is divided in three directions, and the divided tip portions are loosely fitted in a clamp 5 which is formed in the shape of a ring. The above-mentioned ring-shaped clamp 5 is mounted inside a tip portion of a rotor 6 which is arranged to cover the perimeter of the above-mentioned chuck 4 and which is formed cylindrically.

A pipe end 7 is arranged so as to project from the above-mentioned base 2, an end portion of the pipe end 7 is held by a pipe holding member 7A which is fitted to an inner surface of a tip portion of a slider 8 located in the above-mentioned base 2. The above-mentioned slider 8 is formed whose diameter gradually increases towards its end portion (rear end portion) side and whose cylindrical portion is integrally formed in the shape of a staircase. Fitted to its inner surface of the end portion is a circumferential surface at the tip portion of the above-mentioned rotor 6. Further, a holder chuck 9 made of rubber which has formed a through hole 9*a* in an axis portion is fitted to the circumferential surface at the above-mentioned slider 8.

According to the above-mentioned arrangement, a linear lead-inserting hole is so formed as to pass via a through hole 4*a* formed in the chuck 4 and a through hole 9*a* formed along the axis of the above-mentioned holder chuck 9 from the lead case 3 to the above-mentioned pipe end 7. A writing lead (refill lead; not shown) is inserted into the linear lead-inserting hole. Further, a return coil-spring 10 is arranged at a space between the above-mentioned rotor 6 and chuck 4.

In addition, one end portion (rear end portion) of the above-mentioned return spring 10 is accommodated in abutment with an end face of the above-mentioned lead case 3 and the other end portion (front end portion) of the above-mentioned return spring 10 is accommodated in abutment with an annular end face formed in the rotor 6. Therefore, the chuck 4 in the rotor 6 is biased to retreat by action of the above-mentioned return spring 10.

In the mechanical pencil shown in the drawings, when knock operation of a knock part (knock cover; to be set forth later) which is disposed at a rear end portion of the body cylinder 1 is carried out, the above-mentioned lead case 3 advances in the body cylinder 1. The tip of the chuck 4 projects from a clamp 5 to cancel a grasp state of the writing lead. On cancellation of the above-mentioned knock operation, the lead case 3 and the chuck 4 retreat in the body cylinder 1 by action of the return spring 10.

At this time, the writing lead is held in the through hole 9*a* formed at the holder chuck 9. In this situation, the chuck 4 retreats and a tip portion of the chuck 4 is accommodated in the above-mentioned clamp 5, thus the writing lead again comes into the grasp state. That is, the writing lead is grasped and released when the chuck 4 moves back and forth by repeating the knock operation of the above-mentioned knock part (knock cover), whereby the writing lead operates to inch forward from the chuck 4 stepwise.

The above-mentioned rotor 6 shown in FIG. 1 is formed such that a central part in the axial direction is increased in diameter to have a larger diameter portion in which a first cam face 6*a* is formed at one end face (rear end face) of the larger diameter portion, and a second cam face 6*b* is formed at the other end face (front end face) of the larger diameter portion.

On the other hand, at the rear end portion of the above-mentioned rotor 6, a cylindrical upper cam formation member 13 is mounted in the body cylinder 1 so as to cover the rear end portion of the rotor 6. At the front end portion of the above-mentioned upper cam formation member 13, a fixed cam face (also referred to as "first fixed cam face") 13*a* is formed so as to face the first cam face 6*a* of the above-mentioned rotor 6.

Further, although not shown in FIG. 1 but shown in FIG. 2, a lower cam formation member 14 is arranged outside the above-mentioned rotor 6, and the lower cam formation member 14 is mounted on the body cylinder 1 side. At the lower cam formation member 14, a fixed cam face also referred to as "second fixed cam face") 14*a* is formed so as to face the second cam face 6*b* in the above-mentioned rotor 6.

In addition, a relationship and mutual operation among the first and the second cam faces 6*a* and 6*b* which are formed at the above-mentioned rotor 6, the above-mentioned first fixed cam face 13*a*, and the second fixed cam face 14*a* will be described in detail later with reference to FIGS. 4 and 5.

Figure 3:
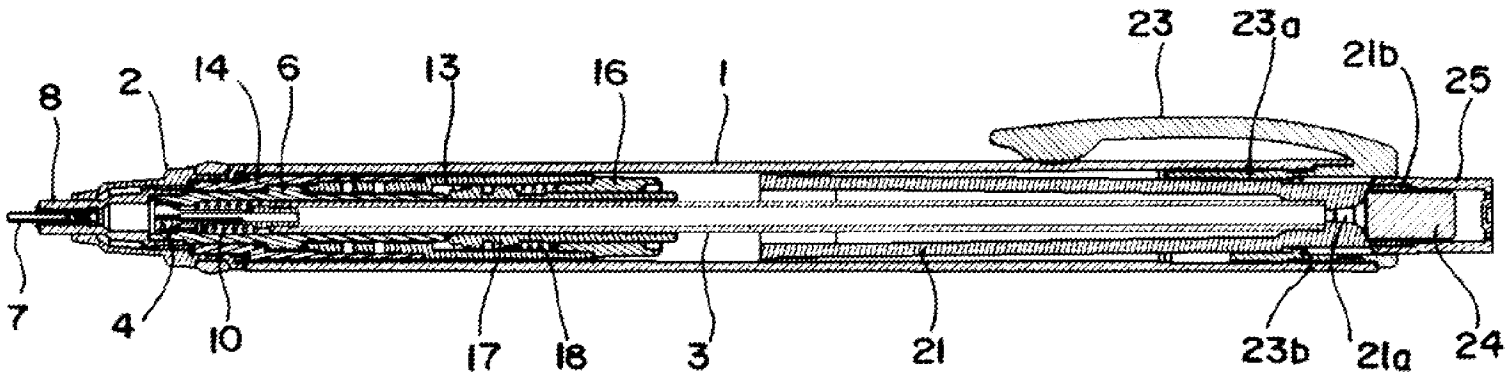
FIG. 3 is a sectional view similarly showing the whole structure of the above-mentioned mechanical pencil.

FIG. 3 generally shows the mechanical pencil as described with reference to FIGS. 1 and 2, and typical parts shown in FIGS. 1 and 2 are indicated by the same reference numerals. As shown in FIG. 3, a cylindrical stopper 16 is fitted to the rear end portion inside the above-mentioned upper cam formation member 13 which is formed cylindrically, and a coil-spring member 18 is provided between a front end portion of the stopper 16 and the torque canceller 17 which is formed cylindrically and can move in the axial direction.

It is arranged that the above-mentioned spring member 18 acts so as to bias forward the above-mentioned torque canceller 17 and the above-mentioned rotor 6 is pushed to move forward by the above-mentioned torque canceller 17 subjected to this bias force.

Further, the cylindrically formed knock bar 21 is accommodated inside the body cylinder 1 on the rear end portion side so as to slide in the axial direction. A part of this knock bar 21 is fitted to the rear end portion of the above-mentioned lead case 3 and is arranged to move back and forth together with the above-mentioned lead case 3 in the body cylinder 1. Further, it is arranged that a cylinder body 23*a* in which a clip 23 is integrally formed at a rear end portion of the body cylinder 1 is fitted into the body cylinder 1 and the above-mentioned knock bar 21 is prevented from protruding towards the rear end side or the body cylinder 1 by a ring-shaped step portion 23*b* formed inside the cylinder body 23*a*.

A rear end portion 21*b* of the above-mentioned knock bar 21 is formed in the shape of a ring and arranged to project a little farther than a rear end portion of the above-mentioned cylinder body 23*a*, and an eraser 24 is accommodated in an inside space at the rear end portion of the above-mentioned knock bar 21. Further, a knock cover 25 which is made of a transparent or translucent resin material and constitutes the knock part so as to cover the above-mentioned eraser 24 is detachably provided so as to cover a perimeter side of the rear end portion of the knock bar 21.

In addition, a refill-lead feeding hole 21*a* is formed at a position where the eraser 24 is accommodated in the above-mentioned knock bar 21.

In the above arrangement, when the knock operation of depressing the above-mentioned knock cover 25 with thumb, for example, is carried out, it acts so that the lead case 3 is pushed forward via the knock bar 21. Thereby, as described above, the chuck 4 moves forward and operates to inch the writing lead out of the pipe end 7. Then, on releasing the above-mentioned knock operation, the knock bar 21 is retreated by action of the return spring 10, and the knock bar 21 is held by the step portion 23*b* formed inside the cylinder body 23*a* which supports the clip 23.

Incidentally, according to the arrangement of the above-mentioned mechanical pencil, in a situation where the chuck 4 grasps the writing lead, the above-mentioned rotor 6 together with the chuck 4 is accommodated in the above-mentioned body cylinder 1 so as to be rotatable about the axis. Further, in a situation where the mechanical pencil is not in use (or not in writing state), the rotor 6 is biased forward by the action of the above-mentioned spring member 18 through the above-mentioned torque canceller 17, resulting in a situation shown in FIGS. 1 to 3.

On the other hand, when the mechanical pencil is used, i.e., when the writing pressure is applied to the writing lead (not shown) extending from the pipe end 7, the above-mentioned chuck 4 retreats against the bias force of the spring member 18. According to this operation, the rotor 6 also retreats in the axial direction. Therefore, the first cam face 6*a* formed at the rotor 6 shown in FIGS. 1 and 2 engages with and meshes with the above-mentioned first fixed cam face 13*a*.

Figure 4:
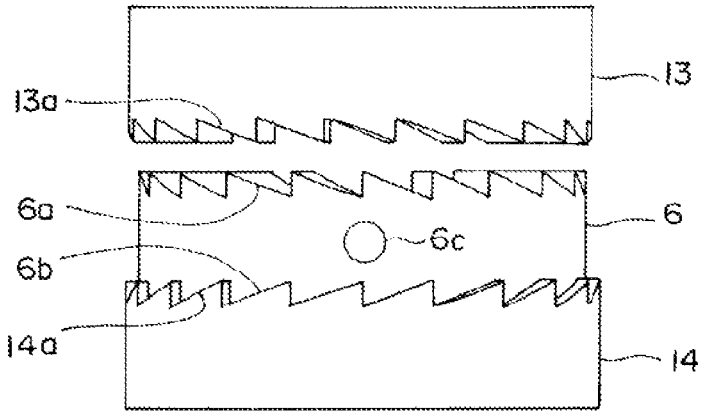
FIGS. 4(A)-4(C) are a schematic view for explaining, in order, rotational drive actions of a rotor installed in the mechanical pencil as shown in FIGS. 1 to 3.
Figure 4:
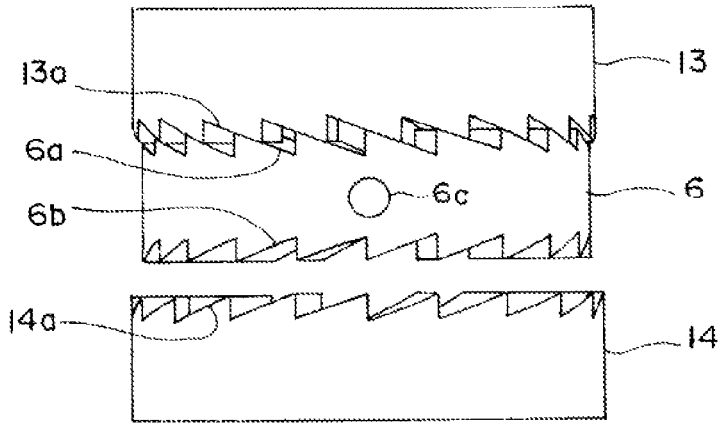
Figure 4:
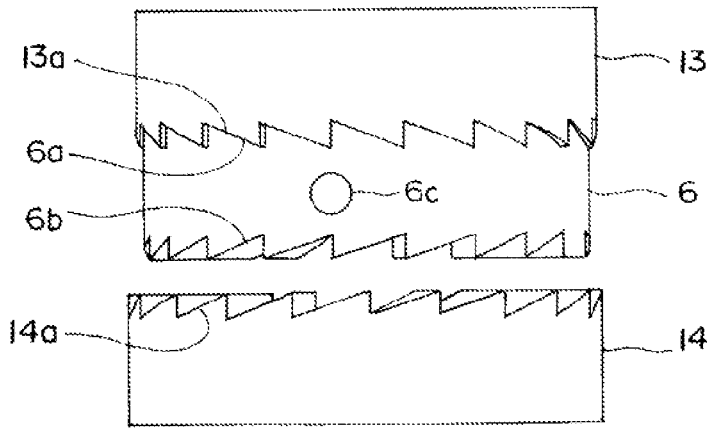
Figure 5:
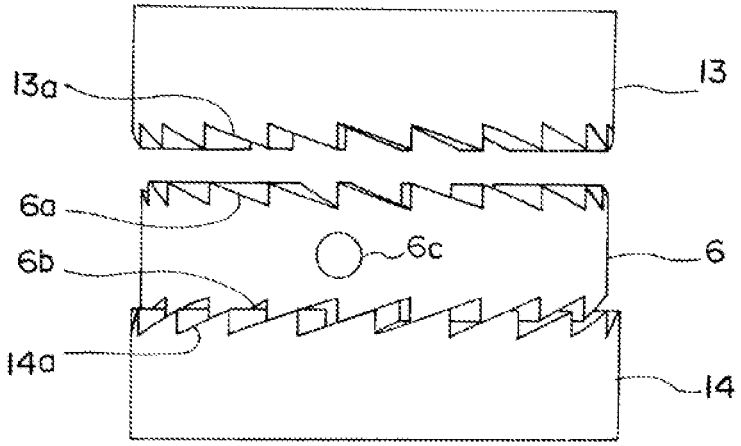
FIGS. 5(A)-5(B) are a schematic view for explaining the rotational drive actions of the rotor, following FIGS. 4(A)-4(C).
Figure 5:
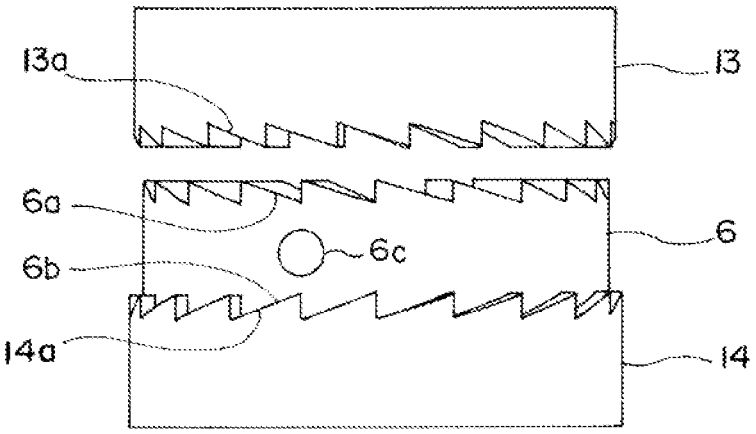

FIGS. 4(A) to 4(C) and FIGS. 5 (A) and 5 (B) are for explaining in order the fundamental operation of a rotational drive mechanism which rotationally drives the rotor 6 by the above-mentioned operation. In FIGS. 4 and 5, reference numeral 6 indicates the above-mentioned rotor which is schematically shown, and at one end face thereof (upper face in figures) the first cam face 6*a* having a continuous sawtooth shape along a circumferential direction is formed into the shape of a ring. Further, similarly, the second cam face 6*b* having a continuous sawtooth shape along the circumferential direction is formed into the shape of a ring at the other end face (lower face in figures) of the rotor 6.

On the other hand, as shown in FIGS. 4 and 5, the first fixed cam face 13*a* having a continuous sawtooth shape along the circumferential direction is also formed at a ring-shaped end face of the upper cam formation member 13, and the second fixed cam face 14*a* having a continuous sawtooth shape along the circumferential direction is also formed at a ring-shaped end face of the lower cam formation member 14.

The cam faces formed into the sawtooth shape along the circumferential direction at the first cam face 6*a* and the second cam face 6*b* formed at the rotor, the first fixed cam face 13*a* formed at the upper cam formation member 13, and the second fixed cam face 14*a* formed at the lower cam formation member 14 are each arranged to have substantially the same pitch.

In addition, circle (○) shown by reference sign 6*c* and drawn in the center of the rotor 6 illustrated in FIGS. 4 and 5 is a mark which is given for convenience in order to explain rotational movement of the rotor 6.

FIG. 4(A) shows a relationship among the upper cam formation member 13, the rotor 6, and the lower cam formation member 14 in the situation where the mechanical pencil is not in use (or not in writing state). In this situation, by the bias force of the spring member 18 shown in FIG. 3, the second cam face 6*b* formed in the rotor 6 is brought into abutment with the second fixed cam face 14*a* side of the lower can formation member 14 mounted at the body cylinder 1. At this time, the first cam face 6*a* on the above-mentioned rotor 6 side and the above-mentioned first fixed cam face 13*a* are arranged to have a half-phase (half-pitch) shifted relationship with respect to one tooth of the cam in the axial direction.

FIG. 4(B) shows an initial situation where the writing pressure is applied to the writing lead by use of the mechanical pencil. In this case, as described above, the rotor 6 compresses the above-mentioned spring member 18 and retreats in the axial direction while the chuck 4 retreats. Thus, the rotor 6 moves to the upper cam formation member 13 side mounted at the body cylinder 1.

FIG. 4(C) shows a situation where the writing pressure is applied to the writing lead by use of the mechanical pencil and the rotor 6 comes into abutment with the upper cam formation member 13 side and retreats. In this case, the first cam face 6*a* formed at the rotor 6 meshes with the first fixed cam face 13*a* on the upper cam formation member 13 side. Thus, the rotor 6 is subjected to rotational drive corresponding to the half-phase (half-pitch) with respect to one tooth of the first cam face 6*a*. Further, in the situation shown in FIG. 4(C), the second cam face 6*b* on the above-mentioned rotor 6 side and the above-mentioned second fixed cam face 14*a* are arranged to have a half-phase (half-pitch) shifted relationship with respect to one tooth of the cam in the axial direction.

Next, FIG. 5(A) shows an initial situation where drawing with the mechanical pencil is finished and the writing pressure to the writing lead is released. In this case, the rotor 6 moves forward in the axial direction by action of the above-mentioned spring member 18. Thus, the rotor 6 moves to the lower cam formation member 14 side mounted at the body cylinder 1.

Furthermore, FIG. 5 (B) shows a situation where the rotor 6 comes into abutment with the lower cam formation member 14 side and moves forward by action of the above-mentioned spring member 18. In this case, the second cam face 6*b* formed at the rotor 6 meshes with the second fixed cam face 14*a* on the lower cam formation member 14 side. Thus, the rotor 6 is subjected again to the rotational drive corresponding to the half-phase (half-pitch) of one tooth of the second cam face 6*b*.

Therefore, as the rotor 6 applied with the writing pressure reciprocates in the axial direction, the rotor 6 is subjected to the rotational drive corresponding to one tooth (one pitch) of the first and second cam faces 6*a* and 6*b*; the writing lead 10 grasped by the chuck 4 is rotationally driven through the chuck 4 similarly, so that the mark 6*c* as shown by circle (○) drawn for convenience at the above-mentioned rotor 6 moves stepwise in the axial direction as illustrated in the figure.

According to the mechanical pencil having the arrangement as described above, each time writing operation causes the rotor 6 to reciprocate in the axial direction, the rotor is subjected to the rotational motion corresponding to one tooth of the cam. By repeating this operation, the writing lead is rotationally driven stepwise in one direction. Therefore, it is possible to prevent the writing lead from locally abrading as the writing proceeds, and it is also possible to solve the problem that the boldness of the drawn line and the thickness of the drawn line may change badly.

Furthermore, according to the mechanical pencil having the arrangement as described above, the pipe end 7 for guiding the writing lead and arranged to project from the base 2 is fitted to the tip portion of the above-mentioned rotor 6 through the pipe holding member 7A and the slider 8. Thus, as the above-mentioned chuck 4 retreats and moves forward in conjunction with the writing operation, the pipe end 7 moves in the same direction through the pipe holding member 7A and the slider 8.

Therefore, if the writing lead reciprocates slightly (which may also be referred to as cushion action) in conjunction with the writing operation, the pipe end 7 for guiding the writing lead also moves in the same direction, whereby relative movement in the axial direction does not take place between the pipe end and the writing lead and an protrusion length of the writing lead from the pipe end 7 can be kept constant.

Further, the pipe end 7 is connected with the above-mentioned rotor 6 through the pipe holding member 7A and the slider 8. Thus, when the writing lead is subjected to the rotational motion, the pipe end is also subjected to the rotational motion similarly, so that the pipe end 7 and the writing lead rotate together.

That is to say, the changes in the protrusion length of the writing lead from the pipe end and relative rotation between the pipe end and the writing lead do not take place so that the writing lead can be prevented from being broken due to the lead scraping at the pipe end, and it is also possible to solve the problem that the paper surface is smeared by scraping of the writing lead.

In addition, on application of the bias force of the above-mentioned coil-like spring member 18, the cylindrical torque canceller 17 (which moves forward the rotor 6) generates a slide between a front end face of the torque canceller 17 and a rear end face of the above-mentioned rotor 6 and acts so that the rotational motion of the above-mentioned rotor 6 generated by repetition of the writing action is prevented from being transmitted to the spring member 18.

In other words, since the torque canceller 17 formed cylindrically is interposed between the above-mentioned rotor 6 and the spring member 18, the rotational motion of the above-mentioned rotor is prevented from being transmitted to the above-mentioned spring member, and it is possible to solve the problem that back torsion (spring torque) of the spring member 18 occurs and places an obstacle to rotational operation of the rotor 6.

Figure 6:
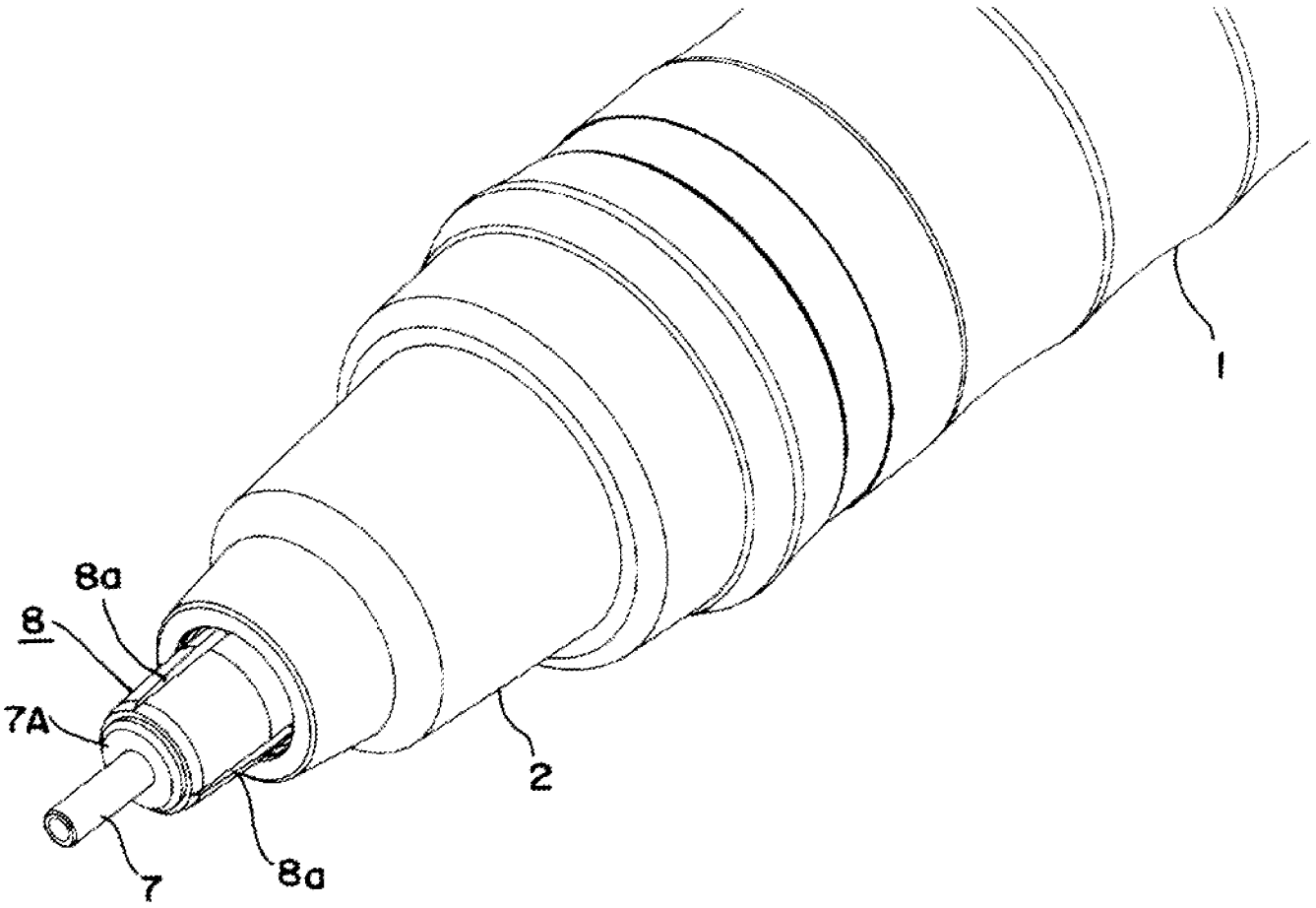
FIG. 6 is a perspective view showing a first example of a display means for displaying a rotational drive state of the rotor.

As for the mechanical pencil shown in FIGS. 1 to 3, FIG. 6 shows the first preferred embodiment in which the rotational operation of the rotor 6 in conjunction with the writing operation, i.e., the rotational drive state of the writing lead interlocking with the above-mentioned rotor 6 is indicated. The example shown in FIG. 6 illustrates an example where a display means with which a rotation state can be checked is provided, at the front of the body cylinder 1, for a part of the component arranged to extend from the body cylinder i.e. the slider 8 for supporting the pipe end 7 through the pipe holding member 7A.

As already described, the slider 8 shown in FIG. 6 is fitted and attached to a front end of the above-mentioned rotor 6, and therefore is similarly rotated in conjunction with the rotational operation of the rotor 6 caused by the writing operation. In this example, a plurality of grooves 8*a* are formed along the axis around a portion extending from the body cylinder 1 at the slider 8 i.e. around a circumference of a cone whose diameter is slightly reduced in a forward direction.

In the example shown in FIG. 6, the above-mentioned grooves 8*a* are equi-spaced circumferentially along the axial direction (at regular intervals of 120 degrees in the illustrated example) Therefore, it is possible to directly see the grooves 8*a* (as the display means provided for the slider 8) rotated in a circumferential direction by rotation of the rotor 6 in conjunction with the writing operation. Thus, it is possible to clearly know that the writing lead together with the above-mentioned rotor 6 is rotationally driven.

Figure 7:
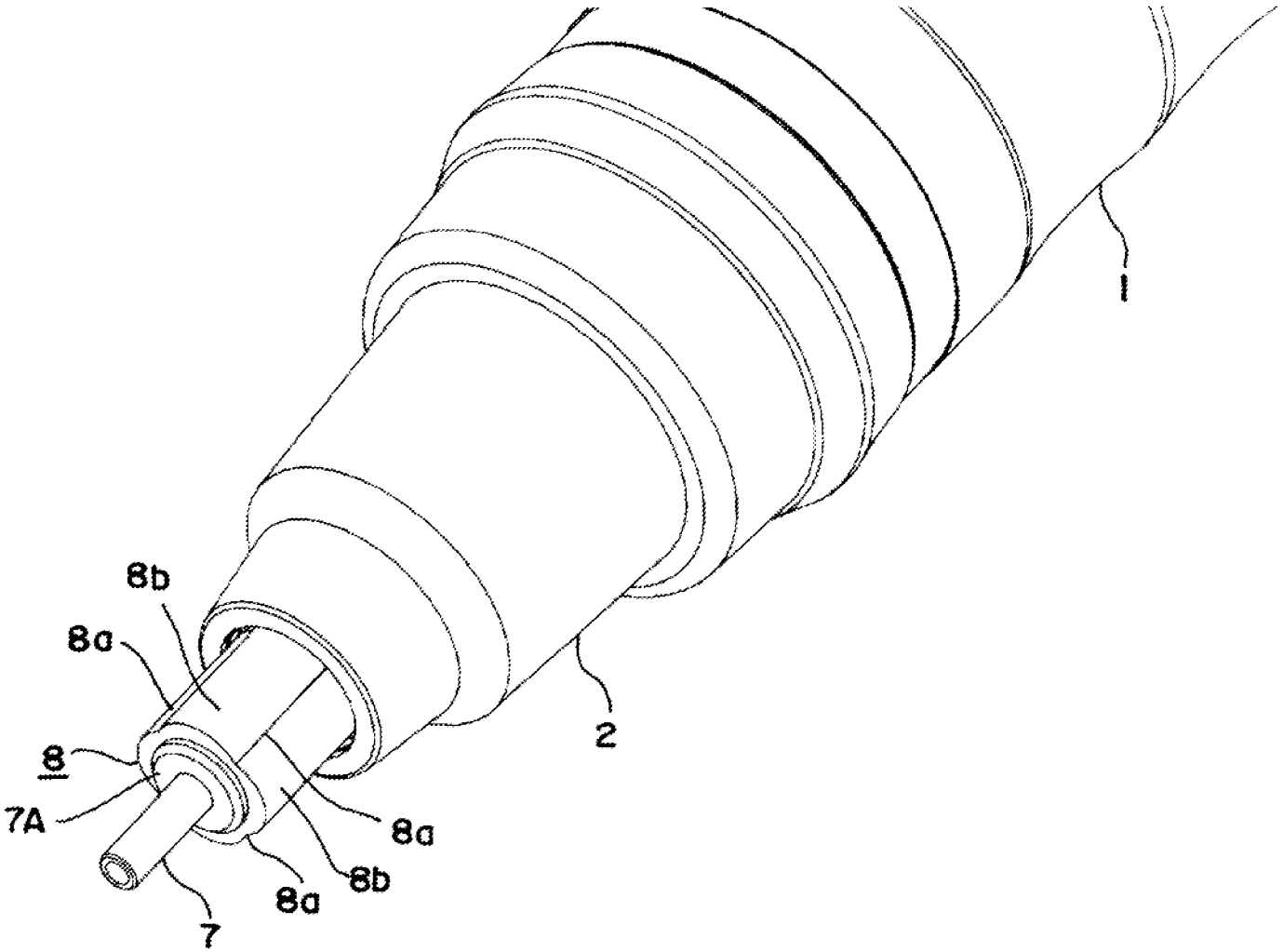
FIG. 7 is a perspective view similarly showing a second example of the display means.

FIG. 7 shows a second example where a display means with which a rotation state can be checked is provided for a part of the slider 8 for supporting the pipe end 7. In this example, a plurality of grooves 8*a* are formed along the axis direction at a portion extending from the body cylinder 1 in the slider 8, and swelling parts 8*b* projecting to have a thickness greater than a radius between each groove and the axis are respectively formed between the above-mentioned grooves 8*a* which adjoin with each other in a circumferential direction.

Figure 8:
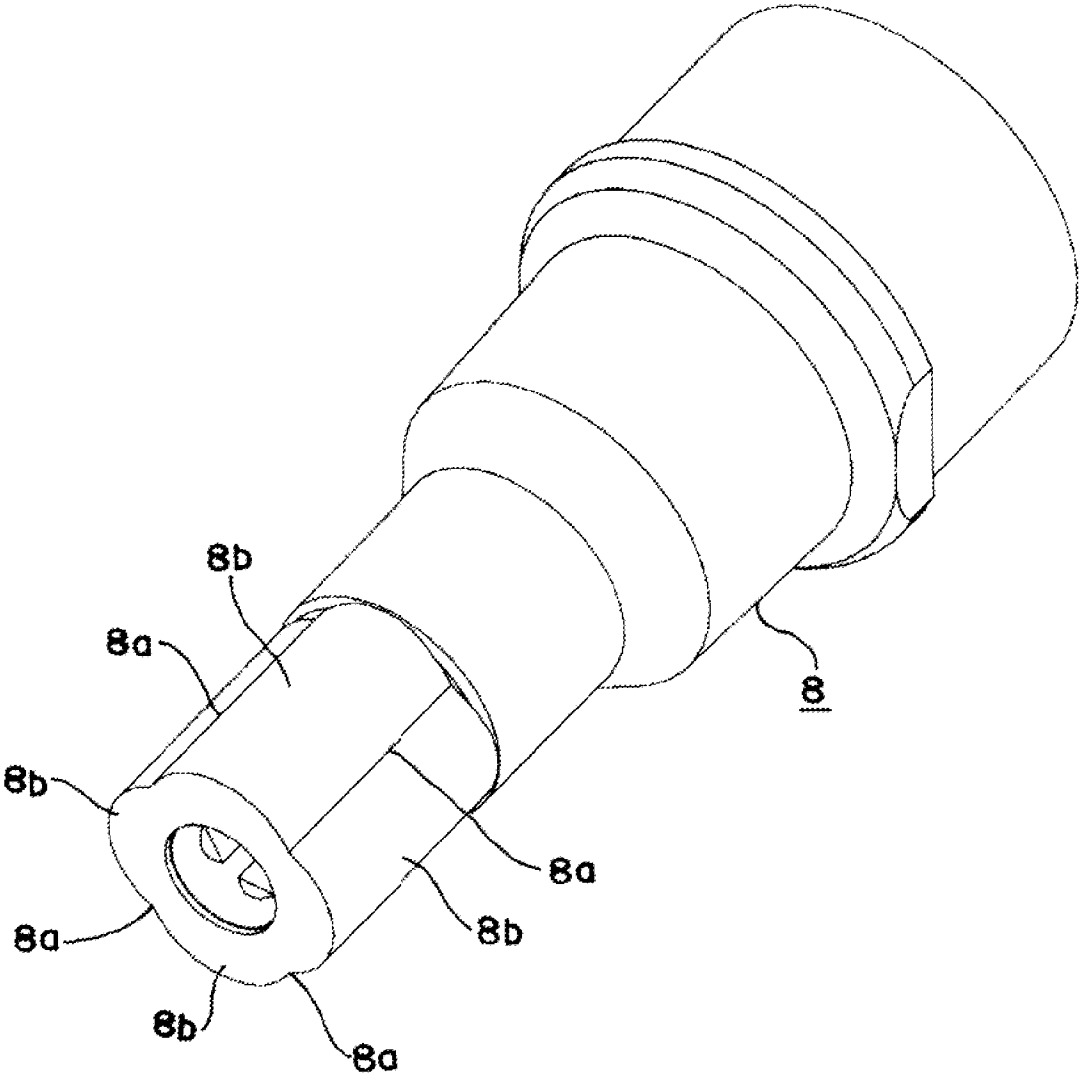
FIG. 8 is a perspective view showing a simple arrangement of a slider used in the preferred embodiment shown in FIG. 7.

In addition, FIG. 8, shows the whole structure of the above-mentioned slider 8 partially shown in FIG. 7. In this example, the above-mentioned grooves 8*a* are provided circumferentially along the axial direction at regular intervals of around 90 degrees. In addition, it is arranged that cylindrically arranged swelling parts 8*b* are respectively formed between the above-mentioned grooves 8*a*.

Also in this arrangement, it is possible to directly see the grooves 8*a* and swelling parts 8*b* (which are provided for the slider 8) rotated in a circumferential direction by the rotation of the rotor 6 in conjunction with the writing operation. Thus, it is possible to clearly know that the writing lead together with the above-mentioned rotor 6 is rotationally driven.

Figure 9:
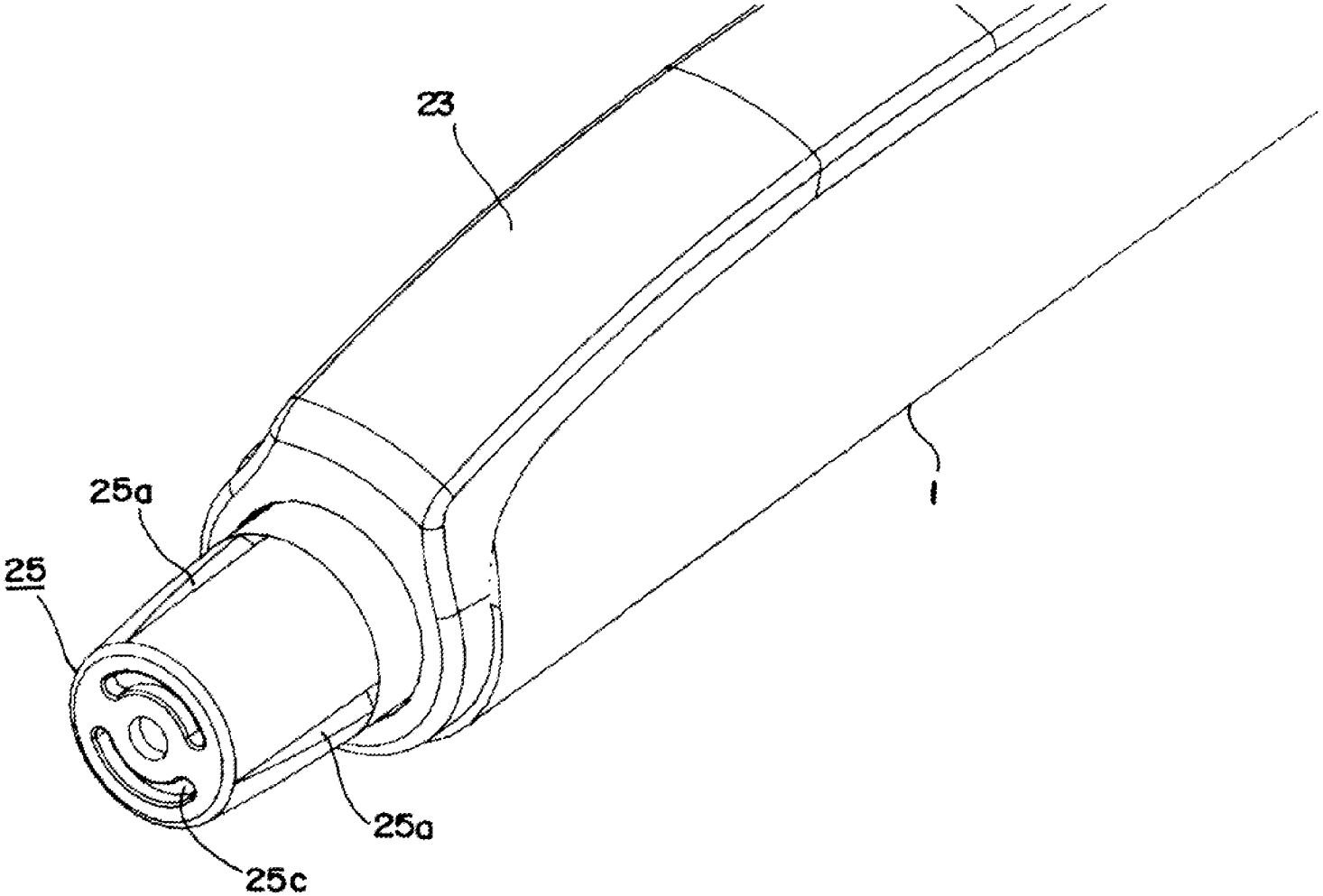
FIG. 9 is a perspective view showing a third example of the display means for displaying the rotational drive state of the rotor.

Next, FIG. 9 shows an example in which a component arranged to extend from the body cylinder and rearwardly of the body cylinder, i.e., the display means with which a rotation state can be checked is provided for a part of the knock cover 25. As already described, in conjunction with the rotational operation of the rotor 6, the above-mentioned knock cover 25 is similarly rotationally driven through the above-mentioned chuck 4, the lead case 3, and the knock bar 21.

In the example shown in FIG. 9, grooves 25*a* are equi-spaced circumferentially along the axial direction (at regular intervals of 120 degrees in the illustrated example) around a circumference of a cone (of the knock cover) whose diameter is slightly reduced in a rearward direction. That is to say, the grooves 25*a* are formed similarly to those in the example in which the grooves 6*a* are provided for the slider 8 as already described with reference to and illustrated in FIG. 6.

It should be noted that reference sign 25*c* indicates an air hole formed in the bottom part of the knock cover 25.

According to this arrangement, it is possible to directly see the grooves 25*a* (provided for the knock cover 25) rotated in a circumferential direction by rotation of the rotor 6 in conjunction with the writing operation. Thus, it is possible to clearly know that the writing lead together with the above-mentioned rotor 6 is rotationally driven.

Figure 10:
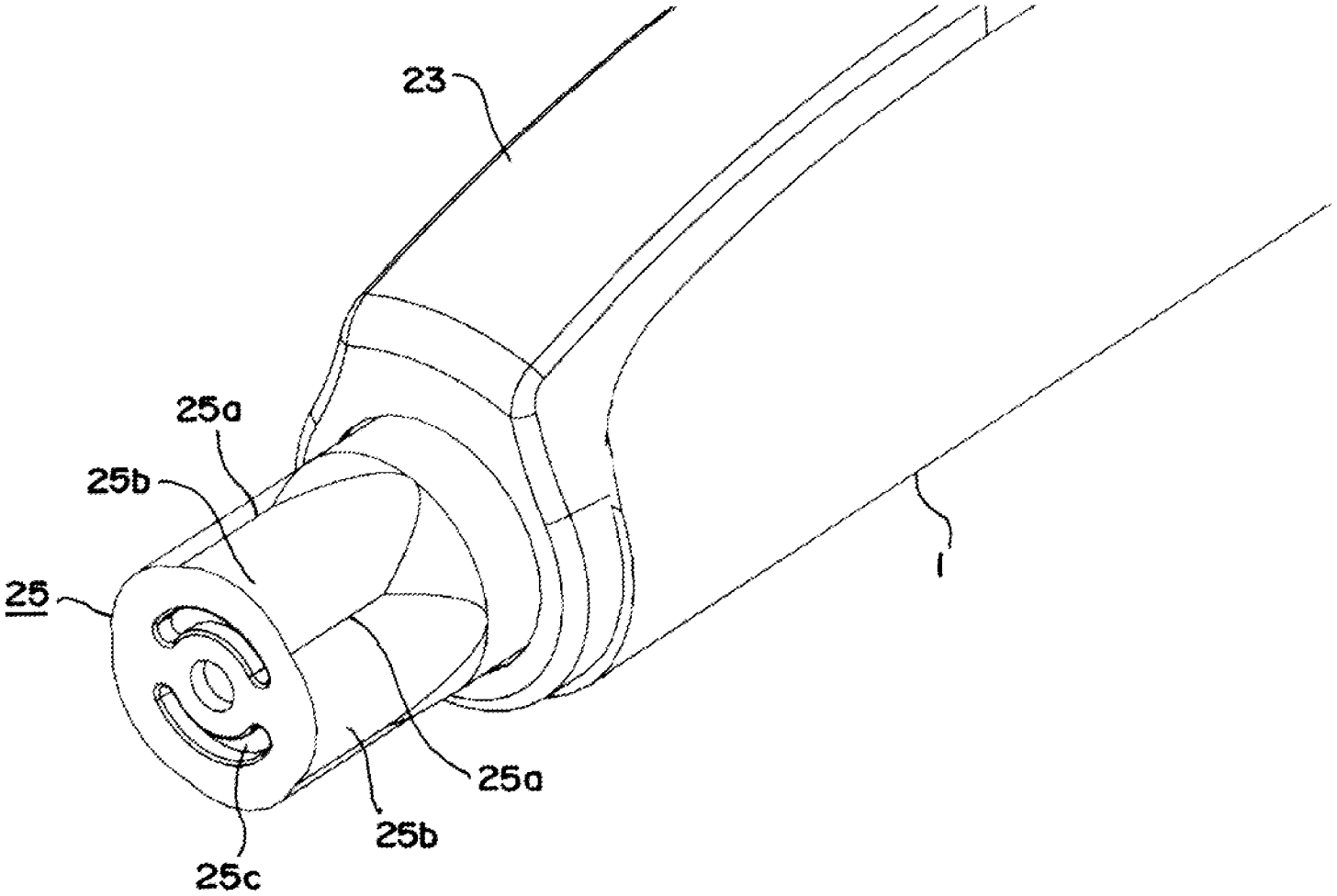
FIG. 10 is a perspective view similarly showing a fourth example of the display means.

FIG. 10 shows a second example where the display means with which the rotation state can be checked is provided for a part of the knock cover 25. In the example shown in FIG. 10, a plurality of grooves 25*a* along the axis are formed at regular intervals around a circumference of the knock cover 25 formed in the shape of a cylinder having a bottom, and swelling parts 25*b* projecting to have a thickness greater than a radius between each groove and the axis are respectively formed between the above-mentioned grooves 25*a* which adjoin with each other in a circumferential direction.

That is to say, the grooves 25*a* and cylindrically arranged swelling parts 25*b* are formed similarly to those provided for the slider 8 shown in FIGS. 7 and 8 as already described. Also in this arrangement, it is possible to directly see the grooves 25*a* and swelling parts 25*b* (provided for the knock cover 25) rotated in a circumferential direction by rotation of the rotor 6 in conjunction with the writing operation. Thus, it is possible to clearly know that the writing lead together with the above-mentioned rotor 6 is rotationally driven.

It should be noted also in FIG. 10 that reference sign indicates an air hole formed in the bottom part of the knock cover 25.

In the preferred embodiments as described above, the slider 8 and the knock cover 25 which are arranged to extend from the body cylinder forwardly or rearwardly of the body cylinder are used, by way of example, as the display means with which the rotation state of the writing lead can be checked, and the example is shown in which a plurality of grooves along the axial direction as well as the thick swelling parts are provided on their surfaces.

However, the display means with which the rotation state of the writing lead can be checked is not restricted to the above-mentioned particular outer shapes, but it may be arranged that the circumference of the section perpendicular to the axis has an outer shape other than a true circle about the above-mentioned axis, that is to say, the cross-sectional shape perpendicular to the axial direction may be formed to have a particular outer shape different from the true circle, and thus the similar operational effects can be expected.

As another example of the above-mentioned display means, it is possible to arrange the above-mentioned display means by forming holes irregularly or by providing irregularities or a cut-out on a part of surfaces of the slider, the knock cover, etc., whose profile is formed in the shape of a cylinder or a cone, whereby the similar operational effects can be expected in this arrangement.

Further, the above-mentioned display means can be arranged by printing and displaying designs, such as a pattern, a mascot, etc., on the surfaces of the slider, knock cover, etc whose profiles are formed in the shape of a cylinder or a cone, or by applying coatings, such as for example, a seal on which the above-mentioned design (a pattern, a mascot, etc.,) is printed to the surfaces of the slider, knock cover, etc. The similar operational effects can also be expected in these arrangements.

In addition, the part where the above-mentioned display means is provided is not limited to the above-mentioned slider 8 which is arranged at the front of the body cylinder, but it may be provided for the above-mentioned pipe holding member 7A or the above-mentioned pipe end 7. Further, in the case where the above-mentioned slider 8, the pipe holding member 7A, and the pipe end 7 are integrally molded, the similar operational effect can also be expected by providing the above-mentioned display means for a part of this molded product.

Furthermore, the part where the above-mentioned display means is provided is not limited to the surface of the above-mentioned knock cover 25 arranged at the rear of the body cylinder, the similar operational effect can also be expected by providing the above-mentioned display means for the annular rear end portion 21*b* (of the knock bar 21) which can be seen through the above-mentioned knock cover 25 formed of the transparent or translucent resin material, as shown in FIG. 3, for example.

DESCRIPTION OF REFERENCE SIGNS

1: body cylinder
2: base
3: lead case
4: chuck
5: clamp
6: rotor
6*a*: first cam face
6*b*: second cam face
6*c*: mark
7: pipe end
7A: pipe holding member
8: slider
8*a*: grooves (display means)
8*b*: swelling part (display means)
9: holder chuck
10: return spring
13: upper cam formation member
13*a*: first fixed cam face
14: lower cam formation member
14*a*: second fixed cam face
16: stopper
17: torque canceller
18: spring member
21: knock bar
21*a*: refill-lead feeding hole
21*b*: annular rear end portion
23: clip
25: knock cover
25*a*: grooves (display means)
25*b*: swelling part (display means)

The invention claimed is:

1. A mechanical pencil arranged to grasp and release a writing lead by reciprocation of a chuck provided in a body cylinder so as to inch said writing lead forward, having a rotational drive mechanism for rotationally driving a rotor in one direction in conjunction with retreat operation of the writing lead into the body cylinder by the writing pressure applied to said writing lead and forward movement of the writing lead from the body cylinder by releasing the writing pressure, and arranged to transmit rotational motion of said rotor to said writing lead, wherein a component arranged to extend from said body cylinder forwardly or rearwardly of said body cylinder is arranged to be rotationally driven in conjunction with the rotational motion of said rotor, and said component is provided with a display means for displaying a rotation state of said component.

2. A mechanical pencil as claimed in claim 1, wherein said display means is printing or a coating provided on said component.

3. A mechanical pencil as claimed in claim 2, wherein said component arranged to extend from the body cylinder forwardly of said body cylinder is a slider for supporting a pipe end.

4. A mechanical pencil as claimed in any one of claim 2, wherein said component arranged to extend from the body cylinder rearwardly of said body cylinder is a knock cover which achieves the reciprocation of said chuck.

5. A mechanical pencil as claimed in claim 1, wherein said display means is arranged by forming a cross-sectional shape perpendicular to an axial direction into a particular shape different from a true circle.

6. A mechanical pencil as claimed in claim 5, wherein grooves are formed on a surface of said component in an axial direction.

7. A mechanical pencil as claimed in claim 6, wherein said component arranged to extend from the body cylinder forwardly of said body cylinder is a slider for supporting a pipe end.

8. A mechanical pencil as claimed in any one of claim 6, wherein said component arranged to extend from the body cylinder rearwardly of said body cylinder is a knock cover which achieves the reciprocation of said chuck.

9. A mechanical pencil as claimed in claim 5, wherein said component arranged to extend from the body cylinder forwardly of said body cylinder is a slider for supporting a pipe end.

10. A mechanical pencil as claimed in any one of claim 5, wherein said component arranged to extend from the body cylinder rearwardly of said body cylinder is a knock cover which achieves the reciprocation of said chuck.

11. A mechanical pencil as claimed in claim 1, wherein said component arranged to extend from the body cylinder forwardly of said body cylinder is a slider for supporting a pipe end.

12. A mechanical pencil as claimed in any one of claim 1, wherein said component arranged to extend from the body cylinder rearwardly of said body cylinder is a knock cover which achieves the reciprocation of said chuck.

* * * * *